US007059053B2

(12) United States Patent
Sakai

(10) Patent No.: US 7,059,053 B2
(45) Date of Patent: Jun. 13, 2006

(54) FOLDING KNIFE WITH BLADE LOCK

(76) Inventor: Kimi Sakai, 6521-212th St. SW., Lynnwood, WA (US) 98036

( * ) Notice: Subject to any disclaimer, the term of this patent is extended or adjusted under 35 U.S.C. 154(b) by 0 days.

(21) Appl. No.: 10/331,156

(22) Filed: Dec. 27, 2002

(65) Prior Publication Data

US 2003/0213134 A1 Nov. 20, 2003

Related U.S. Application Data

(63) Continuation of application No. 09/707,734, filed on Nov. 7, 2000, now abandoned.

(51) Int. Cl.
*B26B 1/04* (2006.01)

(52) U.S. Cl. ..... 30/160; 30/161

(58) Field of Classification Search ..... 30/160, 30/161, 153, 155, 157, 341, 344, 308.2, 321, 30/330, 517, 519
See application file for complete search history.

(56) References Cited

U.S. PATENT DOCUMENTS 598,896 A * 2/1898 Sutton ..... 30/161
1,189,005 A * 6/1916 Seely ..... 30/308.2
1,262,390 A 4/1918 Roth
1,341,153 A * 5/1920 Parker et al. ..... 30/143
1,431,835 A 10/1922 Neft
1,782,901 A 11/1930 Kassel
2,461,941 A * 2/1949 Sutton ..... 30/161
2,617,187 A 11/1952 Hopta
3,868,774 A * 3/1975 Miori ..... 30/161
4,502,221 A 3/1985 Pittman
4,918,820 A * 4/1990 Korb et al. ..... 30/161
5,095,624 A 3/1992 Ennis
5,111,581 A 5/1992 Collins
5,331,741 A 7/1994 Taylor, Jr.
5,461,786 A 10/1995 Miller
5,596,808 A 1/1997 Lake et al.
5,615,484 A 4/1997 Pittman
5,685,079 A 11/1997 Brothers et al.
5,722,168 A * 3/1998 Huang ..... 30/161
5,737,841 A 4/1998 McHenry et al.
5,822,866 A * 10/1998 Pardue ..... 30/161
5,964,036 A 10/1999 Centofante
6,256,888 B1 * 7/2001 Shuen ..... 30/161
6,276,063 B1 8/2001 Chen
6,338,431 B1 1/2002 Onion
6,574,869 B1 * 6/2003 McHenry et al. ..... 30/161

* cited by examiner

*Primary Examiner*—Allan N. Shoap
*Assistant Examiner*—Carolyn Blake
(74) *Attorney, Agent, or Firm*—Christensen O'Connor Johnson Kindness PLLC

(57) ABSTRACT

The blade of a folding knife has a tang portion by which the blade is pivoted to a handle for swinging between an open position and a closed position. In the open position the blade extends from the handle with its sharpened edge exposed for use, whereas in the closed position the sharpened edge is received in a groove of the handle. A locking link is pivotally mounted on the handle for swinging in the same plane as the blade, with a swinging end of the locking link cooperating with a notch in the tang to automatically lock the blade in the open position. The blade can be released for movement to the closed position by manipulation of buttons exposed at the exterior of the handle, which buttons extend transversely from the swinging end portion of the locking link.

9 Claims, 2 Drawing Sheets

FOLDING KNIFE WITH BLADE LOCK

CROSS-REFERENCE TO RELATED APPLICATION

This application is a continuation of application Ser. No. 09/707,734, filed on Nov. 7, 2000 now abandoned.

FIELD OF THE INVENTION

This invention relates to folding knives and, more particularly, to a folding knife that is capable of being locked in an open position with the blade extending from a handle.

BACKGROUND OF THE INVENTION

A popular feature of folding knives is a locking mechanism that prevents the blade of the knife from closing unintentionally and unexpectedly. Two popular types of such locks include the lock back and the liner lock. The lock back structure provides a spring-biased lever mounted along one side of a handle. The lever has a front hook or tooth that engages in a notch in the tang portion of the blade, adjacent to the point of pivotal attachment of the blade to the handle. The liner lock structure provides a thin liner of sheet metal that springs into place behind a flat portion of the tang of the blade, thereby preventing closure until the liner is manually moved out of the way of the blade.

Despite the popularity of these structures, there still are instances of lock failure or, more often, inadvertent releasing of the lock. Another problem is a lock which requires or encourages the user to have a finger or part of his or her hand in the path of a closing blade when the release mechanism is actuated, because of the arrangement of the parts and the actions necessary for releasing the lock.

SUMMARY OF THE INVENTION

The present invention provides an improved lock for a folding knife having a blade pivotally attached to one end of a handle. The blade is movable between an open position in which the blade extends away from the handle and a closed position in which the blade is received within a groove of the handle. The tang portion of the blade, at the opposite side of the blade pivot from the sharpened blade portion, has a peripheral cam edge with a notch for receiving a lock finger or dog when the blade is in the open position. The outer periphery of the tang can have another notch positioned to receive the finger or dog when the blade is in the closed position. The lock finger or dog can be formed by the end of a link that pivots inside the handle in the same plane as the blade. The link is positioned to the rear of the tang of the blade and pivots between a forward swung detent or locking position and a rearward swung free or released position. In the detent or locking position, the dog end of the link rides on the peripheral cam edge of the tang for reception in one of the notches when the blade is in the corresponding position relative to the handle. The dog end of the link is biased forward toward the forward end of the handle and the outer periphery of the tang, and may be moved rearward manually to a released position by manipulation of one or more pins or buttons extending transversely of the locking link adjacent to its dog end. The button or buttons can project from a slot or slots in the handle.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figures 1, 2, 3:
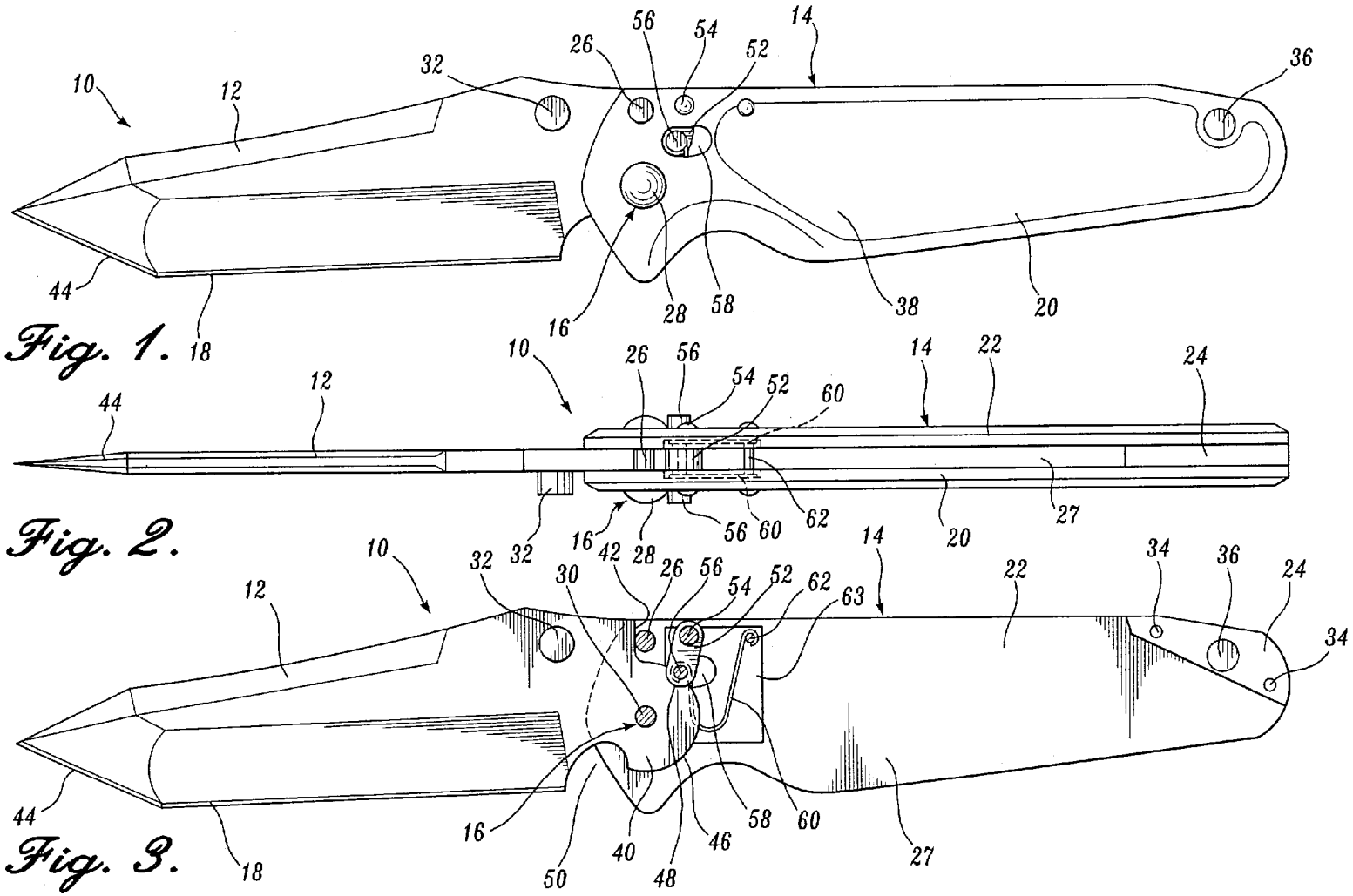
FIG. 1 is a side elevation of a folding knife having a blade lock in accordance with the present invention, the blade of the knife being shown in the open position.
FIG. 2 is a top plan of the knife of FIG. 1.
FIG. 3 is a side elevation corresponding to FIG. 1 with parts broken away to reveal internal components of the knife.

With reference to FIGS. 1–3, a folding knife 10 of the type with which the present invention is concerned has an elongated blade 12 attached to one end portion of a horizontally elongated handle 14 by a pivot pin 16. As described in more detail below, the blade 12 is swingable relative to the handle between the open or working position shown in FIGS. 1–3, in which the blade extends from the handle with its sharpened edge 18 exposed for use, and a closed position in which the blade, or at least its sharpened edge portion, is received in the handle. The present invention provides an improved mechanism by which the blade may be locked in the open position to prevent unintentional or unexpected closing of the knife which could bring the sharpened edge 18 into contact with the hand of a user and cause injury. Preferably, such a lock mechanism will be sturdy, reliable and conveniently operable, i.e., released without bringing the fingers or hand of the user into a dangerous position.

A typical handle 14 can be formed of several pieces. The handle can include opposite side plates 20, 22 with a rear spacer 24 between them. At the front or forward end of the elongated handle, adjacent to the blade, a stop pin 26 extends between the side plates. The side plates are spaced apart uniformly, forming a groove 27 therebetween of a width slightly greater than the maximum width of the knife blade, for receiving the knife blade in the groove between the handle side plates when the blade is in the closed position.

Figure 4:
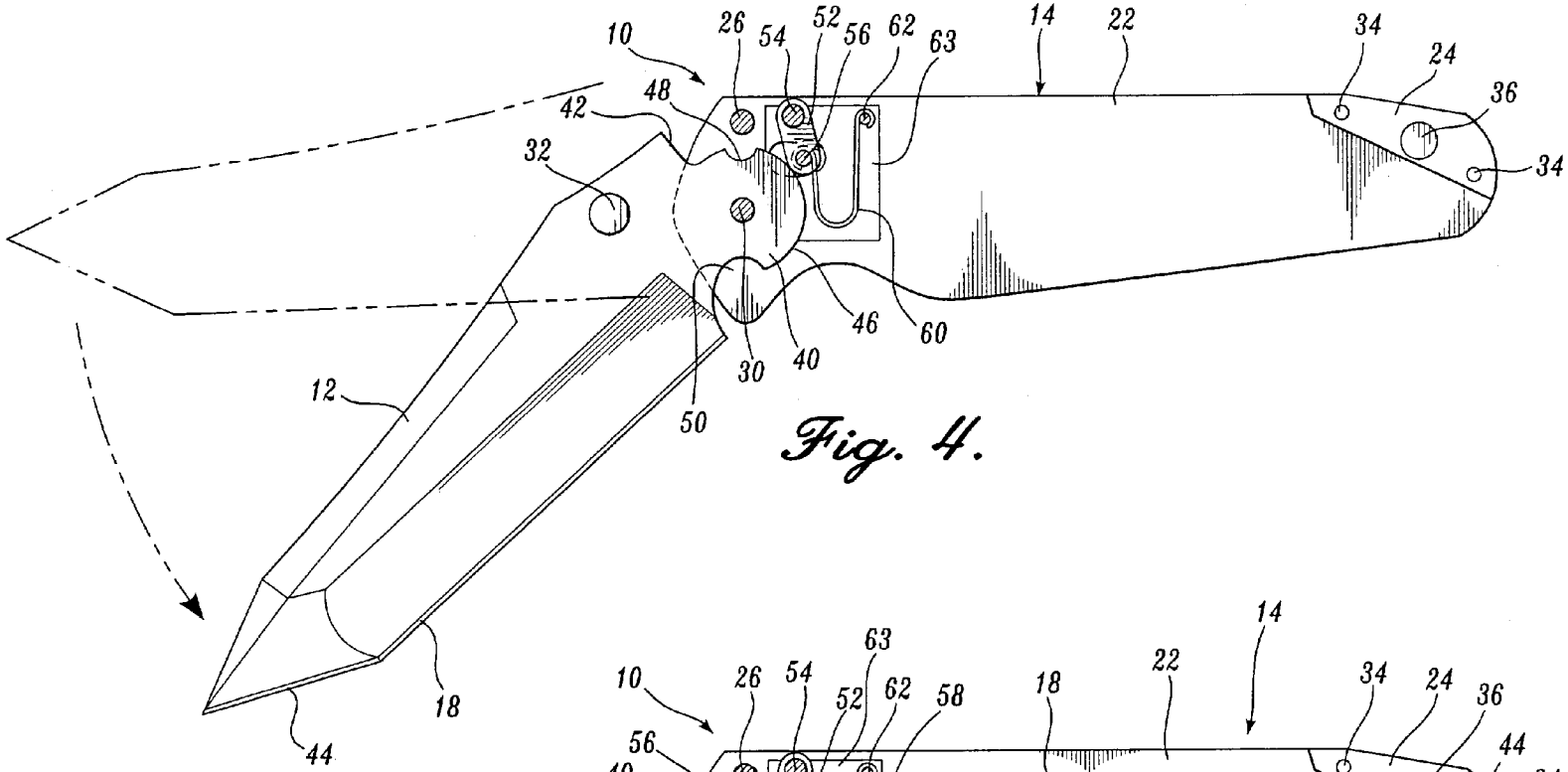
FIGS. 4 and 5 are side elevations corresponding to FIG. 3, with the same parts broken away but with parts in different positions, FIG. 4 showing an intermediate position of the blade and FIG. 5 showing the closed position of the blade.
Figure 5:
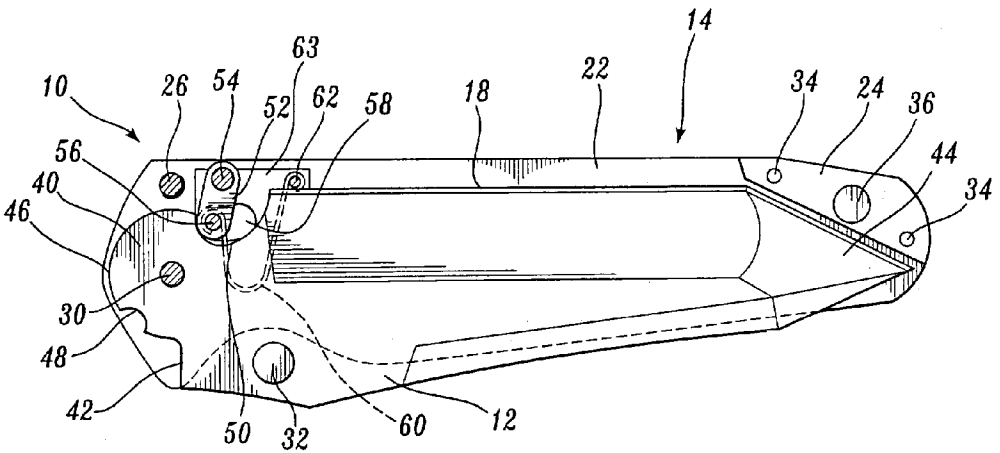

The blade pivot 16 can include outer portions 28 of a diameter greater than the central blade carrying portion 30 (seen in FIGS. 3–5). The blade swings on the central pin portion 30 between the open position (FIG. 3) and the closed position (FIG. 5). The blade can have a transversely projecting thumb pin or tab 32 near its pivoted end. The pin or tab is used to manipulate the blade when moving it from the closed position to the open position, or finger notches or other conventional blade modifications or shapes can be provided for convenient opening of the knife.

As thus far described, the knife components are conventional. The side plates 20, 22 and spacer 24 can be held together by rivets or screws 34 with a through aperture 36 for attachment of the knife handle to a hook or key chain. The pivot pin 30 and stop pin 26 can be stationarily affixed to the side plates, or one or more of pins 26, 30 can have cooperating threaded parts, as is conventional, which allow the blade to be separated from the handle for replacement or cleaning. The side plates can have contoured portions 38

(FIG. 1) for a comfortable grip. The tang portion 40 of the knife blade, at its butt end adjacent to the knife pivot 30, can have a flattened segment 42 extending generally radially relative to the swinging axis of the blade for engaging the stop pin 26 to limit opening of the knife blade 12 relative to the handle 14. The extent of closing of the knife can be determined by the shape and positioning of the spacer 24 relative to the tapered leading end 44 of the knife blade, as seen in FIG. 5.

In accordance with the present invention, the rearwardmost peripheral portion of the tang 40 of the blade forms a generally semicircular cam edge 46. Such edge extends for at least 180° from the flattened stop portion 42 adjacent to the top of the blade to the bottom portion adjacent to the sharpened edge 18 of the blade. The cam edge 46 has notches 48 and 50 that open outward and which cooperate with an upright locking link 52 as described below.

Link 52 has its upper end portion journaled on a pivot pin 54 extending between the side plates 20, 22, at the side of the handle opposite the opening through which the blade swings. From an upright position, the bottom end of the link can swing generally lengthwise of the handle, forward toward the blade tang and front end of the handle, and rearward away from the tang and toward the rear end of the handle, through a small acute angle relative to vertical (i.e., transversely of the length of the horizontally elongated handle). Actuating buttons 56 project transversely from the bottom or swinging end portion of the link 52 through generally horizontally elongated slots 58 in the handle side plates 20, 22. U-shaped compression springs 60 have their opposite ends connected, respectively, to a cross pin 62 and the actuating buttons 56 at opposite sides of the locking link 52. Such springs 60 bias the link to a forward swung position, toward the rear edge of the tang 40 and the front end of the handle. The springs can be nested in recesses 63 in the inside surfaces of the handle side plates 20, 22 so as not to interfere with swinging of the blade.

With reference to FIG. 3, in the open position of the blade 12, the arcuate bottom end portion of the locking link fits in the notch 48. Preferably, the notch is substantially semicircular, complemental to the shape of the bottom end of the link. In such position, swinging of the knife blade 12 relative to the handle 14 is prevented by engagement of the notched tang against the bottom end portion of the locking link. Force applied to the top of the blade in a closing direction is transmitted by way of notch 48 in an upward direction, generally lengthwise of the link toward its pivot pin 54, transversely of the length of the handle. To release the blade, the user need only press rearward on either of the operating buttons 56 (i.e., lengthwise of the handle), thereby swinging the link to a position in which its bottom end portion is no longer engaged in the notch 48. The blade then can be swung to its closed position, through the position of FIG. 4 to the position of FIG. 5. Releasing the lock by manipulation of one of the buttons is accomplished conveniently and safely because the user's hand typically will lie over the top of the handle 14 and neither the fingers nor hand need to be placed or are encouraged to be placed over the bottom opening of the handle slot 27, in a location where the sharpened edge 18 of the blade would engage them.

In the illustrated embodiment, the notch 50 at the opposite side of the tang from notch 48 receives the swinging end portion of the locking link 52 when the knife is in the closed position shown in FIG. 5. From the position of FIG. 5, opening movement applied manually to the blade will swing the locking link 52 rearward against the biasing force of the springs 60 until the swinging end of the link has moved sufficiently to ride on the semicircular cam edge portion 46 of the tang 40. See, for example, the position of FIG. 4. To obtain this result, notch 50 must be gradually curved toward the tip of the blade, forming a recess within which the locking link may swing as the blade is opened.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A knife comprising:

an elongated handle having a front end portion, a rear end portion, and a groove extending lengthwise of the handle from the front end portion to the rear end portion;

a blade having a sharpened edge and a tang, said tang being pivotally attached to the front end portion of the handle for swinging of the blade between an open position in which the blade extends from the handle with the sharpened edge exposed for use and a closed position in which the sharpened edge is received in the handle groove, the handle groove having an opening through which the sharpened edge of the blade swings when it is moved between its open and closed positions, the tang having a peripheral cam edge including a first notch opening outward;

a locking link having a lock end portion and a pivot end portion, the locking link being pivotally attached to the handle toward the front end portion and adjacent to a side of the handle opposite the groove opening for swinging in the same plane as the blade, the locking link extending transversely of the length of the handle from its pivotal attachment toward the handle groove opening; and a spring biasing the lock end portion of the link to a forward swung position toward the tang of the blade and the front end portion of the handle, the lock end portion of the locking link being manually movable rearward away from the tang of the blade generally lengthwise of the handle toward the rear end portion of the handle against the biasing force of the spring to release the blade for swinging from the closed position toward the open position, the lock end portion of the locking link being received in the first notch so as to interfit with the tang when the blade is in the open position and the locking link is biased forward to prevent swinging of the blade in a direction from the open position toward the closed position.

2. The knife defined in claim 1, including at least one actuating button projecting transversely of the locking link for manipulation of the position of the locking link, the handle having opposite side plates and an elongated slot extending generally lengthwise of the handle through one of said plates and receiving the actuating button with the button accessible from the exterior of such plate for manipulation thereof forward and rearward in the slot generally lengthwise of the handle.

3. The knife defined in claim 1, in which the first notch is substantially semicircular and the lock end portion of the locking link is substantially semicircular and complemental to the first notch.

4. The knife defined in claim 1, in which the first notch and locking link are constructed and arranged relatively such that with the lock end portion of the locking link received in the first notch, force applied to the blade in a closing direction is transmitted by way of the first notch to the link in a direction substantially lengthwise of the locking link and transversely of the length of the handle.

5. The knife defined in claim 1, including a second notch located at the opposite side of the tang from the first notch for cooperating with the locking link to bias the blade to the closed position.

6. The knife defined in claim 5, in which the second notch is gradually curved from the tang toward the sharpened edge of the blade, forming a recess in which the lock end portion of the locking link may swing as the blade is moved from the closed position toward the open position.

7. The knife defined in claim 5, in which the second notch is contoured for cooperating with the lock end portion of the locking link to bias the blade toward the closed position without locking the blade in the closed position.

8. The knife defined in claim 5, in which the tang of the blade has a generally semicircular peripheral between the first notch and the second notch.

9. A knife comprising:

an elongated handle having a front end portion, a rear end portion, and a groove extending lengthwise of the handle from the front end portion to the rear end portion;

a blade having a sharpened edge and a tang, said tang being pivotally attached to the front end portion of the handle for swinging of the blade between an open position in which the blade extends from the handle with the sharpened edge exposed for use and a closed position in which the sharpened edge is received in the handle groove, the handle groove having an opening through which the sharpened edge of the blade swings when it is moved between its open and closed positions, the tang having a peripheral cam edge including a first notch opening outward;

an elongated locking link having a lock end portion and a pivot end portion, the pivot end portion of the locking link being pivotally attached to the handle toward the front end portion and adjacent to a side of the handle opposite the groove opening for swinging in the same plane as the blade, the length of the locking link extending transversely of the length of the handle from its pivotal attachment toward the handle groove opening; and a spring biasing the lock end portion of the locking link to a forward swung position toward the tang of the blade and the front end portion of the handle, the lock end portion of the locking link being manually movable rearward away from the tang of the blade generally lengthwise of the handle toward the rear end portion of the handle against the biasing force of the spring to release the blade for swinging from the closed position toward the open position, the lock end portion of the locking link and the tang of the blade having respective portions that interfit when the blade is in the open position and the locking link is biased forward to prevent swinging of the blade in a direction from the open position toward the closed position.

* * * * *

UNITED STATES PATENT AND TRADEMARK OFFICE

CERTIFICATE OF CORRECTION

PATENT NO. : 7,059,053 B2
APPLICATION NO. : 10/331156
DATED : June 13, 2006
INVENTOR(S) : K. Sakai It is certified that error appears in the above-identified patent and that said Letters Patent is hereby corrected as shown below:

| COLUMN | LINE | ERROR |
|---|---|---|
| 4 (Claim 1, line 25) | 36 | "of the link" should read --of the locking link-- |
| 5 (Claim 8, line 2) | 17 | "peripheral between" should read --peripheral edge between-- |

Signed and Sealed this

Sixteenth Day of October, 2007

JON W. DUDAS
*Director of the United States Patent and Trademark Office*